US005938450A

United States Patent [19]

Nagafuji

[11] Patent Number: 5,938,450

[45] Date of Patent: Aug. 17, 1999

[54] CONNECTOR HAVING IMPROVED NOISE-SHIELDING STRUCTURE

[75] Inventor: Toshiaki Nagafuji, Tokyo, Japan

[73] Assignee: NEC Corporation, Japan

[21] Appl. No.: 08/902,779

[22] Filed: Jul. 30, 1997

[30] Foreign Application Priority Data

Jul. 30, 1996 [JP] Japan ..... 8-200655

[51] Int. Cl.[6] ..... H01R 9/09

[52] U.S. Cl. ..... 439/63; 439/608; 439/931

[58] Field of Search ..... 439/63, 675, 578, 439/79, 931, 608

[56] References Cited

FOREIGN PATENT DOCUMENTS 5-21111 1/1993 Japan .
5-159832 6/1993 Japan .

*Primary Examiner*—Neil Abrams
*Assistant Examiner*—J. F. Duverne
*Attorney, Agent, or Firm*—Ostrolenk, Faber, Gerb & Soffen, LLP

[57] ABSTRACT

In a high-speed transmission connector having a male connector and a female connector adapted to connect with the male connector, the male connector is provided with a first outer conductor enveloping a contact pin. The female connector is provided with a conductive socket member which is for being brought into contact with the contact pin with the contact pin inserted to the socket member when the female connector is connected to the male connector. The female connector is further provided with a second outer conductor enveloping the socket member which is for being brought into contact with the first outer conductor with being inserted to the first outer conductor so that the first outer conductor are kept at an earth potential through the second outer conductor when the female connector is connected to the male connector.

19 Claims, 7 Drawing Sheets

CONNECTOR HAVING IMPROVED NOISE-SHIELDING STRUCTURE

BACKGROUND OF THE INVENTION

This invention relates to a high-speed transmission connector for transmitting a high-speed signal.

A high-speed transmission connector of the type suffers noise and impedance mismatching as major problems. In order to solve both of these problems, a combination of a coaxial connector and a coaxial cable is required. However, such a combination not only has a complicated structure but also is difficult to assemble. Under the circumstances, proposals have recently been made of various connectors for the purpose of removing the above-mentioned disadvantages.

For example, a conventional connector is disclosed in Japanese Unexamined Patent Publication No. 159832/1993. The conventional connector is attached to a printed board through metal blocks. In the conventional connector, a long time is required in order to actually attach the connector to the printed board as will far later be described in conjunction with the drawing. Since the metal blocks is heavy in weight and is difficult to handle, it is difficult to keep a balance of the connector in a condition where the connector is attached to the printed board. In addition, the connector has no means for assuring impedance matching although it is required in those connectors of the type. Therefore, a desired transmission characteristic can not be achieved.

Another conventional connector is disclosed in Japanese Unexamined Patent Publication No. 21111/1993 as a stacking connector having a simplified coaxial structure. The stacking connector has disadvantages in which it is difficult to achieve impedance matching known in the art and which a high-density and a small-scale structure can not be achieved.

SUMMARY OF THE INVENTION

It is therefore an object of this invention to provide a high-speed transmission connector which has improved noise-shielding structure.

It is another object of this invention to provide a high-speed transmission connector which is easily assembled, light in weight, and reduced in size and which can assure impedance matching.

Other objects of this invention will become clear as the description proceeds.

According to an aspect of this invention, there is provided a high-speed transmission connector comprising a male connector and a female connector adapted to connect with the male connector. The male connector comprises a conductive contact pin, a first outer conductor enveloping the contact pin, and a first insulator housing holding the contact pin and the outer conductor. The female connector comprises a conductive socket member for being brought into contact with the contact pin with the contact pin inserted to the socket member when the female connector is connected to the male connector, a second outer conductor enveloping the socket member for being brought into contact with the first outer conductor with being inserted to the first outer conductor so that the first outer conductor are kept at an earth potential through the second outer conductor when the female connector is connected to the male connector, and a second insulator housing holding the socket member and the second outer conductor.

According to another aspect of this invention, there is provided a high-speed transmission connector comprising a male connector and a female connector adapted to connect with the male connector. The male connector comprises a plurality of conductive contact pins arranged parallel to one another to have a predetermined fashion, a plurality of cylindrical outer conductors enveloping the contact pins, respectively, and a first insulator housing holding the contact pins and the cylindrical outer conductors. The female connector comprises a plurality of cylindrical conductive members arranged parallel to one another to have the predetermined fashion, each of the cylindrical conductive members being brought into contact with each of the contact pins when the female connector is connected to the male connector, a plurality of cylindrical insulator portions enveloping the cylindrical conductive members, respectively, each of the cylindrical insulator portions being inserted in each of the cylindrical outer conductors when the female connector is connected to the male connector, a plurality of metal films formed around the cylindrical insulator portions, respectively, each of the metal films being brought in contact with each of the cylindrical outer conductors so that the cylindrical outer conductors are kept at an earth potential when the female connector is connected to the male connector, and a second insulator housing holding the cylindrical conductive members and the cylindrical insulator portions.

According to still another aspect of this invention, there is provided a high-speed transmission connector comprising a male connector and a female connector adapted to connect with the male connector. The male connector comprises a plurality of conductive contact pins arranged in a matrix fashion, a first insulator housing having introducing holes for insertion of the contact pins and having inner and outer surfaces entirely covered with a metal film, and a plate attached to a rear side of the first insulator housing, the plate being penetrated by a plurality of contact pins arranged in a matrix fashion and being entirely covered with a metal film except those portions of front and rear walls around the contact pins. The female connector comprises a plurality of conductive socket members each of which is inserted into each of the introducing holes to be brought into contact with the contact pins in the first insulator housing when the female connector is connected to the male connector, cylindrical conductors each of which is inserted into each of the introducing holes in the first insulator housing to be brought into contact with the metal film formed on an internal wall of the introducing hole when the female connector is connected to the male connector, a second insulator housing to which the conductive socket members and cylindrical conductors are implanted, and inner and outer terminals extending from rear ends of the conductive socket members and the cylindrical conductors, respectively.

According to yet another aspect of this invention, there is provided a high-speed transmission connector comprising a male connector and a female connector adapted to connect with the male connector. The male connector comprises a plurality of contact pins arranged in a matrix fashion, a first insulator housing having an opening formed at its one end and accommodating the contact pins so that the contact pins penetrating a bottom of the first insulator housing, the first insulator housing having a protruding portion protruding from an internal wall of the bottom around each of the contact pins and having a tapered top end, and a locking spring portion of a metal material arranged around the protruding portion, the first insulator housing having inner and outer surfaces covered with a metal film except the locking spring portion and the protruding portion around the contact pins. The female connector comprises a second insulator housing having a chambered recessed portion to be fitted to the protruding portion and having holes for insertion of the contact pins, a plurality of conductive socket members held to the second insulator housing to be brought into contact with the contact pins when the female connector is connected to the male connector, and a metal film covering the second housing except an internal wall around the contacts.

DESCRIPTION OF THE PREFERRED EMBODIMENTS

Figure 1:
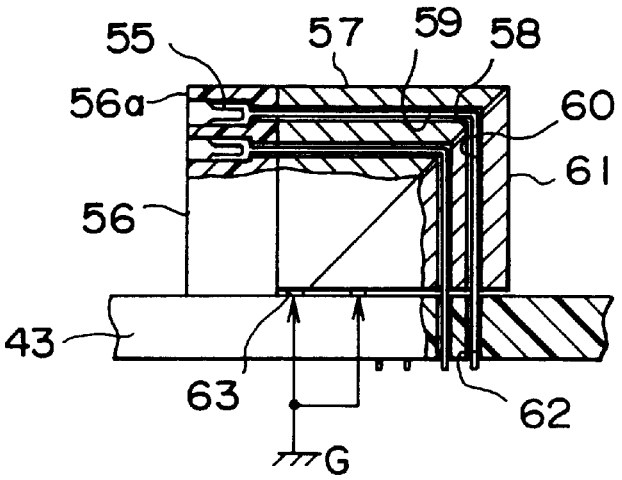
FIG. 1 PRIOR ART
FIG. 1 is a sectional view of a conventional high-speed transmission connector.

At first, description will be made as regards conventional high-speed transmission connectors with reference to the drawing for better understanding of this invention.

Referring to FIG. 1, a first conventional high-speed transmission connector 56 corresponds to that is disclosed in Japanese Unexamined Patent Publication No. 159832/1993 and comprises a housing 56*a* formed by an insulating member and accommodating a plurality of contacts 55 for insertion of plugs of a male connector. Two metal guide members as first and second guide members 57 and 61 are arranged at a rear side of the connector 56 and coupled to each other at their slant surfaces fitted together.

A lead terminal portion 58 extending from each contact 55 is made to pass through a guide hole 59 of the first guide member 57. At the slant surfaces, the lead terminal portion 58 is perpendicularly bent, made to pass through a guide hole 60 of the second guide member 61, and connected to a through hole 62 in a wiring board 43. The first and the second guide members 57 and 61 in the form of metal blocks are brought into contact with a pad 63 as ground of the wiring board 43 to be kept at an earth potential. Thus, in the above-mentioned connector, the lead terminal portion 58 coated with an insulator film is shielded by the metal blocks so as to minimize the influence of noise at the lead terminal portion 58.

The first conventional connector is attached to the printed board through the metal blocks. To actually attach the connector to the printed board, the lead terminal is inserted into the first guide member having a plurality of arrays. Then, the lead terminal is bent. Thereafter, the lead terminal is inserted into the second guide member. Thus, a long time is required in assembling. In addition, the guide members of a metal material having a shielding function is heavy in weight and is difficult to handle. When the connector is attached to the wiring board, it is difficult to keep a balance. When attached to an apparatus, the connector is in an overhanging condition so that the terminal may possibly be released. In addition, the connector has no means for assuring impedance matching although it is required in those connectors of the type. Therefore, a desired transmission characteristic can not be achieved.

Figure 2:
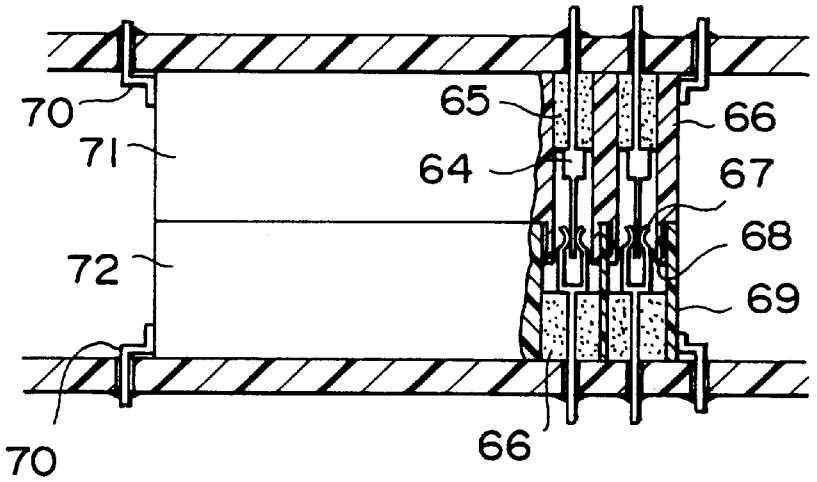
FIG. 2 PRIOR ART
FIG. 2 is a sectional view of another conventional high-speed transmission connector.

Referring to FIG. 2, a second conventional high-speed transmission connector corresponds to that is disclosed in Japanese Unexamined Patent Publication No. 21111/1993 as a stacking connector having a simplified coaxial structure for connecting parallel substrates to each other. The connector comprises an insulator 69 having a plurality of cavities surrounding contact springs 67 for clamping male contacts 64. The insulator is plated by a conductive plating material. The male and the female contacts are fitted into insulators 66. Thus, male and female connectors 71 and 72 are formed. The insulator in the male connector has a projecting piece 68 having a spring characteristic to be connected to an internal wall of each cavity formed in the insulator of the female connector.

Upon coupling the male and the female connectors, the projecting piece 68 is connected to the internal wall of the cavity in the insulator of the female connector 72. The conductive plating material is soldered by an earth potential terminal 70 of a printed board to interrupt each contact at the earth potential. Thus, the structure similar to the coaxial cable is realized. In addition, impedances can be easily set by selecting the shapes of the male and the female contacts, an inner diameter of each cavity surrounded by the insulator 69 subjected to conductive plating, dielectric constants of the insulators 66 holding the contacts, and so on.

It is described that, in the second conventional connector, impedances can be easily set by selecting the shapes of the contacts, the inner diameter of the internal cavity in the insulator subjected to conductive plating, and the dielectric constants of the insulators holding the contacts. However, it is difficult in such narrow cavity to selectively carry out electric plating by the use of a mask. In addition, impedance matching can not be achieved because plating in a uniform thickness is impossible in the narrow cavities for all contact portions.

The resin member contributing to setting of the impedance is molded simultaneously with the connector body. To this end, a molding die requires a core for holding the contacts of a metal material. The presence of the core inhibits the contact pitch from being narrowed. Therefore, a high-density and a small-scale structure can not be achieved. In order to solve the above-mentioned disadvantage, proposal is made of a method of molding the resin member with the contacts preliminarily embedded and inserting the contacts into holes of the connector body. However, this method is unfavorable because enormously large manhole is required in order to insert the contacts embedded in the insulator one by one into the holes of the connector body.

Now, the description will be made about embodiments of this invention with reference to the drawing.

Figure 3A:
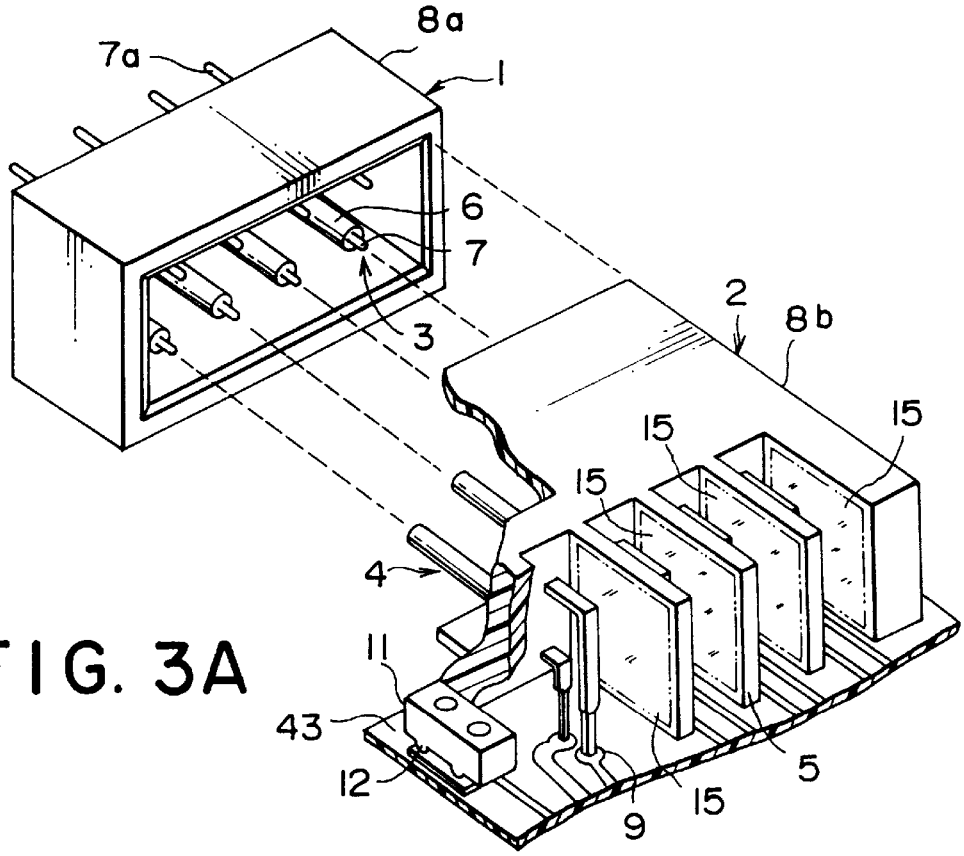
FIG. 3A is a perspective view of a high-speed transmission connector according to a first embodiment of this invention.
Figure 3B:
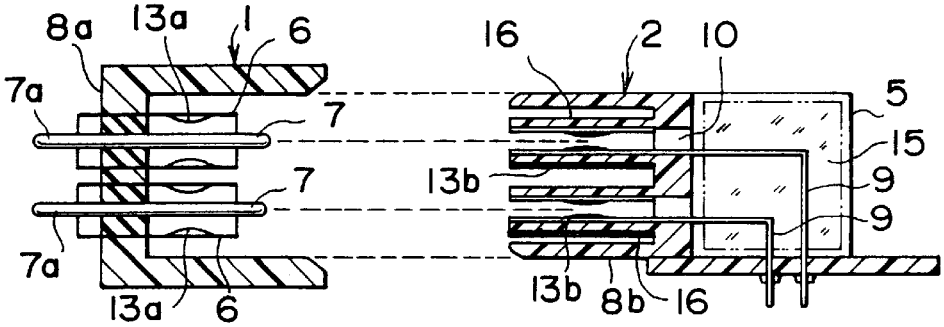
FIG. 3B is a sectional view of the high-speed transmission connector of FIG. 3A.
Figure 3C:
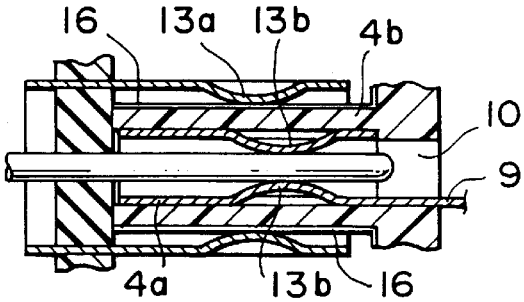
FIG. 3C is a sectional partial view of the high-speed transmission connector of FIG. 3A.

Referring to FIGS. 3A through 3C, a high-speed transmission connector according to a first embodiment of this invention comprises a male connector 1 and a female connector 2 which is adapted to connect with the male connector 1.

The male connector 1 comprises a box-shaped housing 8*a* of a resin material having an opening formed at one end thereof. A plurality of male contact portions 3 are arranged on a bottom of the housing 8*a* in a matrix fashion and held to the housing 8*a*. Each of the male contact portions 3 comprises a contact pin 7 and a cylindrical outer conductor 6 as a first outer conductor. The contact pin 7 has one end provided with a solder terminal portion 7*a* outwardly protruding from an outer wall of the bottom of the housing 8*a* and has another end extending within the housing 38*a* from an inner wall of the bottom towards the opening. The cylindrical outer conductor 6 envelopes the contact pin 7 and penetrates the bottom of the housing 8*a*.

The female connector 2 comprises a plurality of female contact portions 4. Each of the female contact portions 4 comprises a cylindrical conductive member or socket member 4*a*, a cylindrical insulator portion 4*b* of a resin material, and a metal plating film 16. The cylindrical conductive member 4*a* has a clamping leaf spring portion 13*b* to contact and hold an outer peripheral surface of each of the contact pins 7 inserted upon coupling with the male connector 1. The cylindrical insulator portion 4*b* is clamped and held through the metal plating film 16 by a clamping leaf spring portion 13*a* of each of the cylindrical outer conductors 6 inserted simultaneously with the insertion of the contact pins 7. So that the cylindrical outer conductors 6 are kept at an earth potential.

The female connector further comprises a housing 8*b* accommodating and holding the female contact portions 4 arranged on an internal wall of a bottom thereof. The housing 8*b* is provided at its rear side with terminals 9. Each of the terminals 9 extends from each of rear ends of the cylindrical members 4*a*, protrudes outwards from each of holes 10 of the housing 8*b*, and bends to be inserted into and connected to each of through holes of a wiring board 43.

The housing 8*b* is further provided with insulator walls or partition walls 5 which are for shielding or noise-shielding the terminals 9 from one another. Each of the partition walls 5 has a metal plating film 15 formed as a wall metal layer on one surface thereof to serve as a microstrip line known in the art.

The cylindrical outer conductor 6 shields the contact pin 7 and the conductive cylindrical member 4*a* via the cylindrical protruding portion 4*b*. Upon coupling of the connectors, the cylindrical outer conductor 6 is brought into contact with a metal plating film 16 formed as a second outer conductor on the cylindrical protruding portion 4*b*. A metal film is found on a projecting portion 12 of an attaching portion 11. A metal plating film is formed as a housing metal layer on an outer surface of the housing 8*b* and connected to the metal plating film 15. The metal film on the projection portion 12 is connected to the metal plating film 16 through the metal plating film on the housing 8*b*. The attaching portion 11 is fixed to a grounding pad of a wiring board 43, for example, by the use of a bolt so as to provide stable grounding. Therefore, the metal plating films 15 and 16 are electrically connected to the grounding pad. Thus, a coaxial structure is obtained by connection of the male contact portions 3 and the female contact portions 4.

In the above-mentioned connector, the microstrip lines are formed by the metal plating films 15 on the surfaces of the partition walls 5 and the terminals 9. By preliminarily considering and selecting the distance between each partition wall 5 and each terminal 9, the dielectric constant of each partition wall 5, and the thickness of the metal plating film 15, the microstrip lines are designed so as to obtain appropriate characteristic impedances at the male/female coupling portion and the terminal portion of the female connector.

Although each terminal 9 extending outwards from the cylindrical member 4*a* of the female connector 2 is perpendicularly bent in the figure, the shape is not restricted thereto. For example, in order to reduce conductor resistance of each terminal 9, the terminal may be slantly bent to reduce its length. The clamping leaf spring portions 13*a* and 13*b* have leaf springs press-formed to inwardly protrude and are plated at contact portions by a precious metal such as gold and palladium so as to improve reliability of connection. For convenience of illustration, the male and the female contact portions 3 and 4 of the male and the female connectors 1 and 2 are specifically defined in the figure. However, it is obvious that the male and the female can be reversed.

Figure 4A:
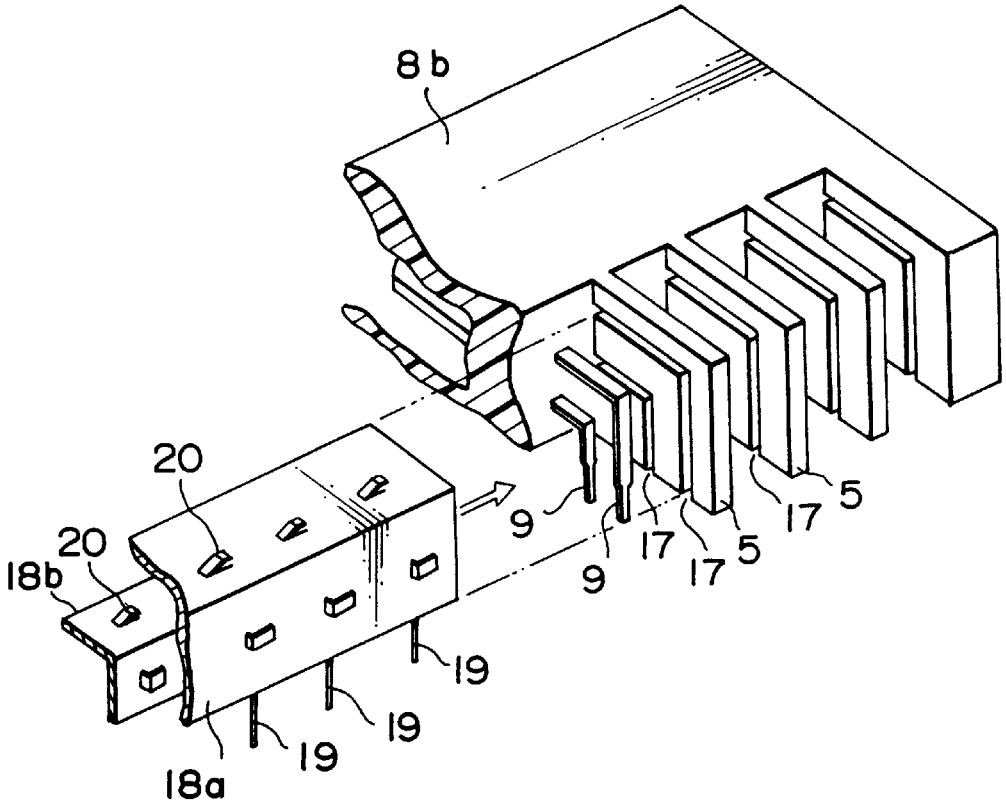
FIG. 4A is a perspective view of a modification of a female connector included in the high-speed transmission connector of FIGS. 3A–3C.
Figure 4B:
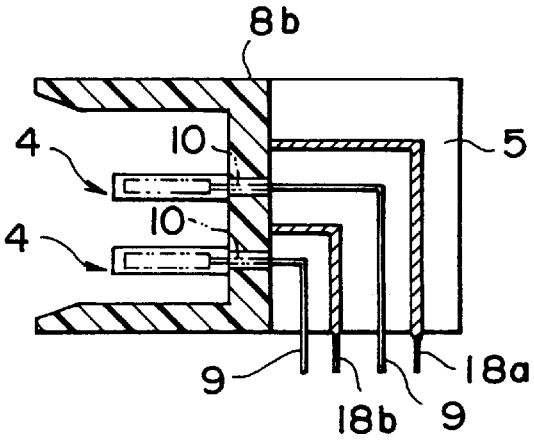
FIG. 4B is a sectional view of the female connector of FIG. 4A.

Referring to FIGS. 4A and 4B, the description will be made as regards a modification of the female connector illustrated in FIGS. 3A through 3C. Similar parts are designated by like reference numerals. In the female connector 2 of FIGS. 3A through 3C, shielding in the horizontal direction is provided by the partition walls 5 while no shielding is provided in the vertical direction so that noise may possibly enter between those of the terminals 9 which are adjacent in the vertical direction.

In the female connector 2 of FIGS. 4A and 4B, each of the partition walls 5 is provided with slits 17. Metal grounding plates 18*a* and 18*b* are inserted through the slits 17 and assembled. The grounding plates 18*a* and 18*b* are provided with elastic locking pieces 20 to be connected to the metal plating film on the housing 8*b* through metal plating layers of the slits 17, and with solder terminals 19 for connection with a grounding layer or through holes of the printed board. Like the foregoing embodiment, the housing 8*b* is entirely plated by a metal material except the holes 10 for insertion of the terminals 9.

By providing the partition walls 5 and the grounding plates 18*a* and 18*b* at the rear side of the female connector 2, the terminals are completely shielded from one another. As described above, it is possible to achieve a design such that appropriate characteristic impedances are obtained at the male/female coupling portion and the terminal portion of the female connector.

Figure 5A:
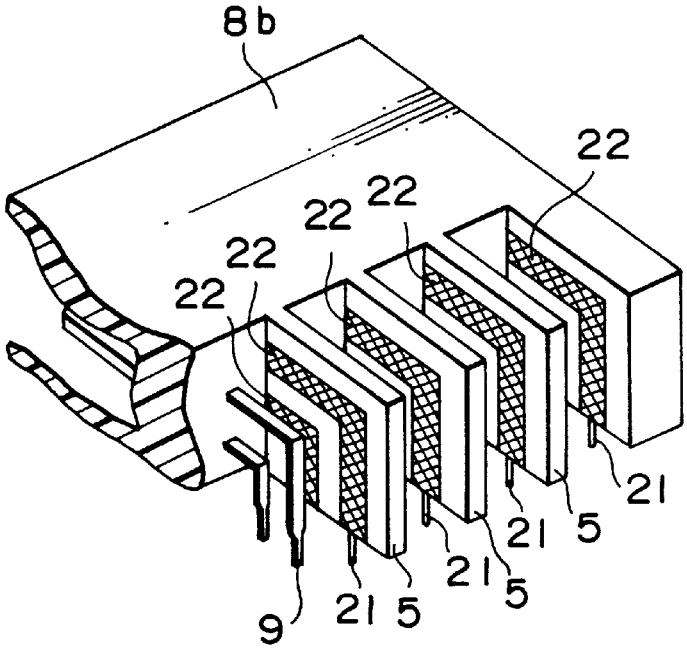
FIG. 5A is a perspective view of another modification of a female connector included in the high-speed transmission connector of FIGS. 3A–3C.
Figure 5B:
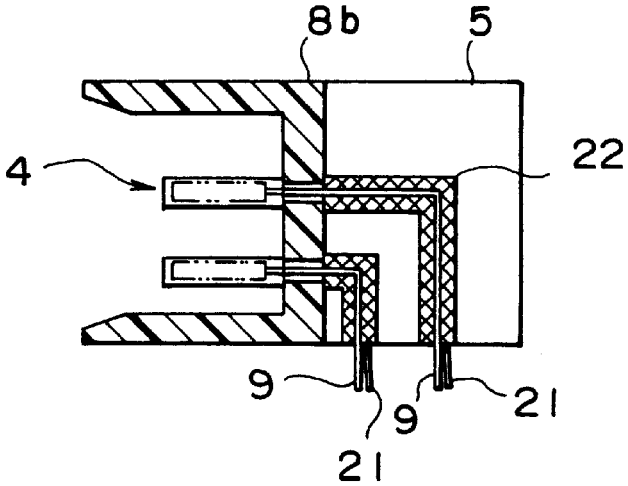
FIG. 5B is a sectional view of the female connector of FIG. 5A.

Referring to FIGS. 5A and 5B, the description will be made as regards another modification of the female connector illustrated in FIGS. 3A through 3C. Similar parts are designated by like reference numerals.

In the female connector, the partition walls 5 separating adjacent ones of the terminals 9 have grounding layers 22 each of which is formed by metal plating for each individual terminal 9. In the female connector of FIGS. 3A through 3C, each of the partition walls 5 is entirely plated to form a common ground so that ground noise may be produced by simultaneous driving. In view of the above, the grounding layers 22 are provided for every individual signal terminals and extend parallel to the terminals 9 along the partition walls 5, respectively. The grounding layers 22 are connected to the metal plating films 16, respectively. Thus, the effect of suppressing the occurrence of noise is expected. In order to connect the grounding layers 22 of the partition walls 5 to the wiring board, metal-plated holes (not shown) are provided and solder terminals 21 are press fitted into the holes in the manner known in the art.

Figure 6A:
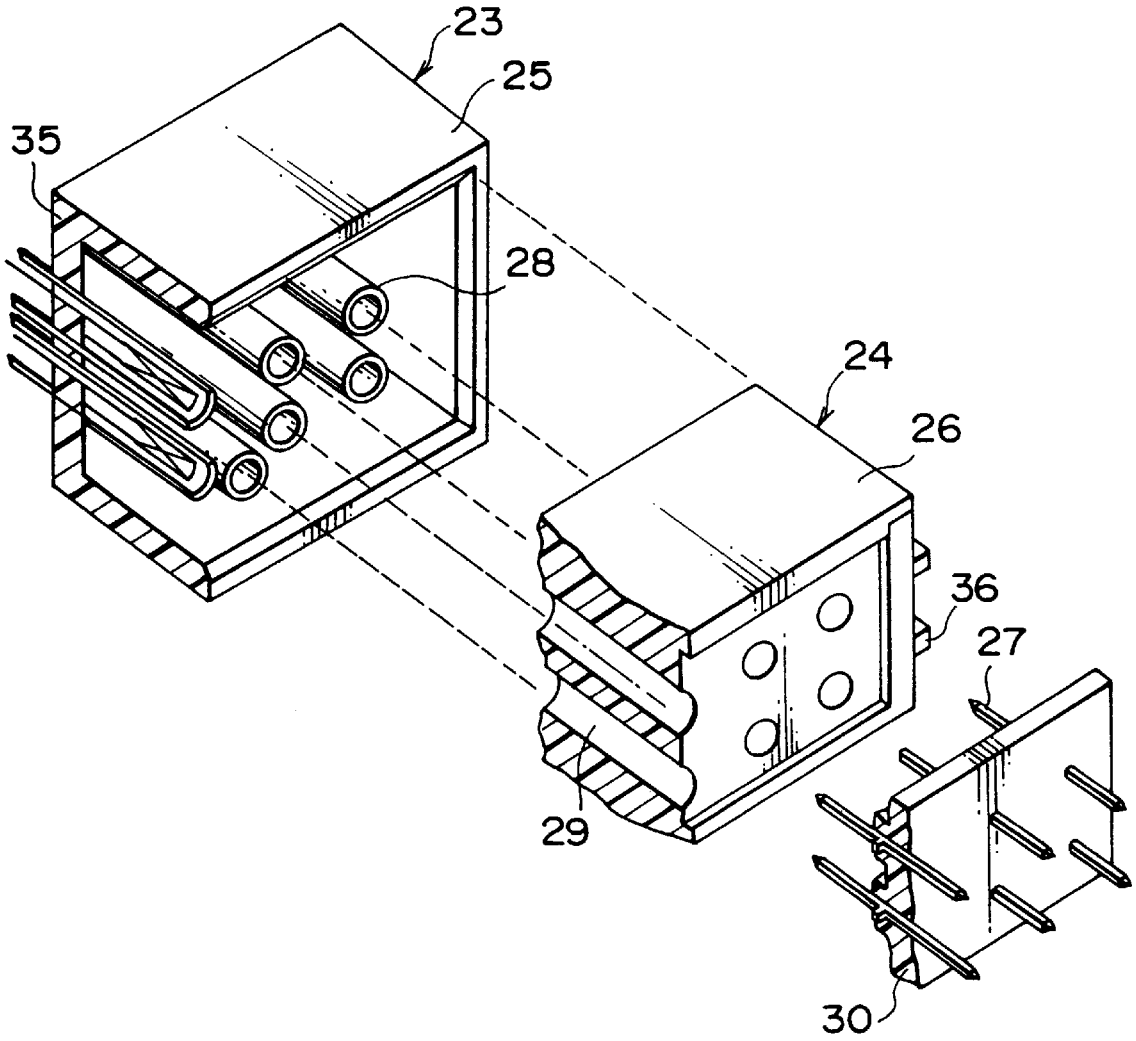
FIG. 6A is a perspective view and a sectional view of a high-speed transmission connector according to a second embodiment of this invention.
Figure 6B:
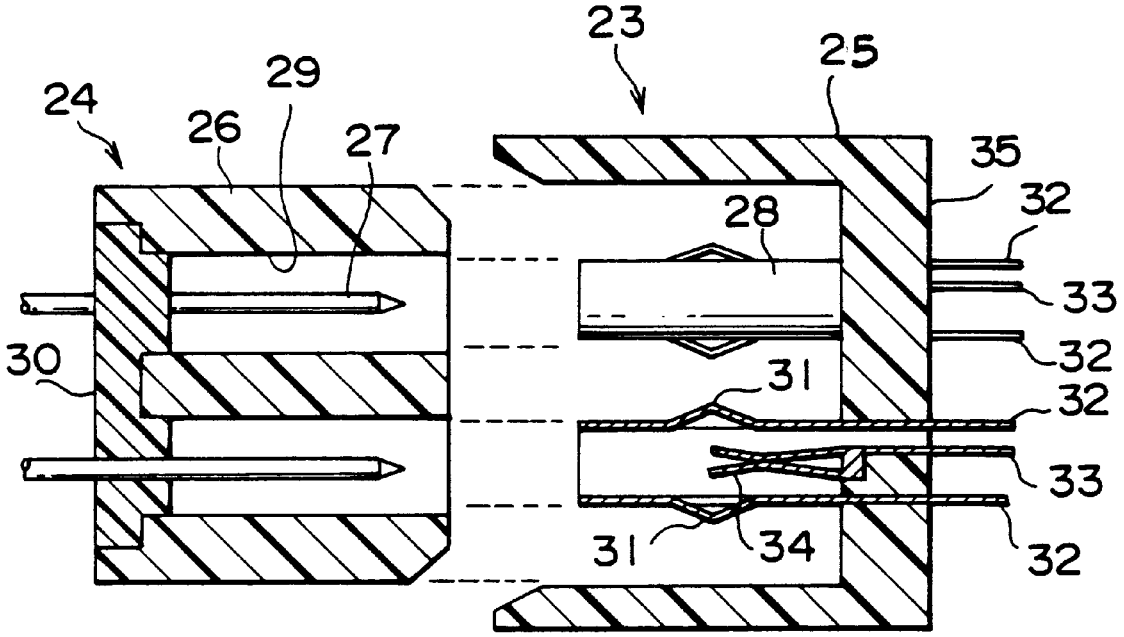
FIG. 6B is a sectional view of the high-speed transmission connector of FIG. 6A.
Figure 6C:
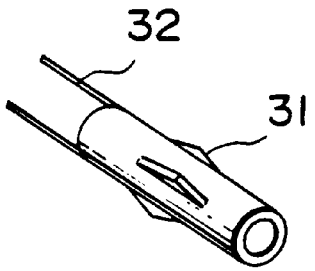
FIG. 6C is a conductive socket member included in the high-speed transmission connector of FIGS. 6A and 6B.

Referring to FIGS. 6A through 6C, the description will be made as regards a high-speed transmission connector according to a second embodiment of this invention. The high-speed transmission connector comprises a male connector 24 and a female connector 23 adapted to connect with the male connector 24.

The male connector 24 comprises a block-shaped housing 26 provided with a plate 30 attached to a rear side thereof. The plate 30 is penetrated by a plurality of contact pins 27 arranged in a matrix fashion. The plate 30 is entirely subjected to metal plating except those portions of front and rear walls around the contact pins 27. The housing 26 is provided with introducing holes 29 for insertion of the contact pins 27. The housing 26 has inner and outer surfaces entirely covered with a metal plating film.

The female connector 23 comprises a cylindrical contacts 28 each of which comprises an inner terminal 33 as a center conductor and an outer terminal 32 surrounding the inner terminal 33. The inner terminal 33 is conductive and has a clamping portion 34 for receiving, clamping, and holding a top end of each of the contact pins 27 upon coupling. The outer terminal 32 is conductive and has a leaf spring portion 31 arranged around the inner terminal 33. The leaf spring portion 31 is inserted into each of the introducing holes 29 of the housing 26 to be brought into contact with the metal plating film formed on an internal wall of the introducing hole 29.

The female connector 23 further comprises a box-shaped housing 25 formed so that the cylindrical contacts 28 are implanted to a rear wall 35. In this event, the outer terminals 32 and the inner terminals 33 extend from rear ends of the contacts 28 through the rear wall 35 with protruding outwards from the rear wall 35.

Each of the housings 25 and 26 of the female and the male connectors and the plate 30 is formed by an insulating resin material. The housing 26 is entirely subjected to metal plating. A metal plating film at an attaching portion 36 of the housing 26 is brought into contact with an earth pad of a wiring board. The connector is used as a stacking connector which is for connecting parallel substrates.

In the manner similar to the high-speed transmission connector illustrated in FIGS. 3A through 3C, the plate 30 may be provided with partition walls to separate terminals, i.e. the rear ends of the contact pins 27 and subjected to metal plating except those portions holding the terminals. In addition, the terminals are bent into an L shape. In this event, the wiring board can be connected in an orthogonal direction, like the first embodiment. It is noted here that the male and the female connectors are attached in a reverse manner.

Figure 7:
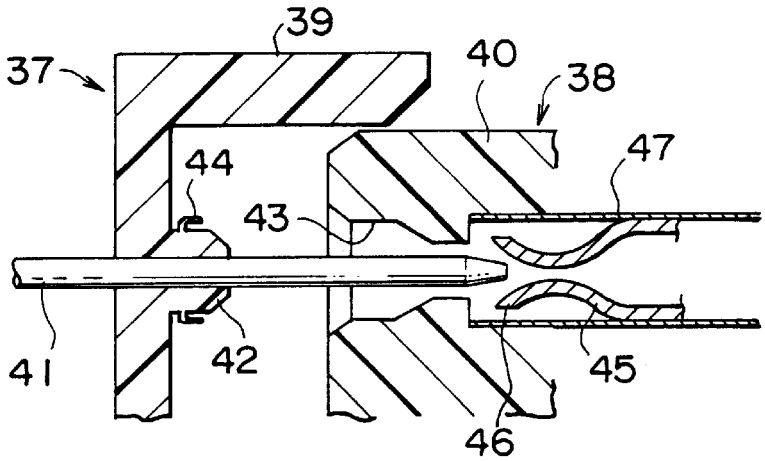
FIG. 7 is a sectional partial view of a modification of a connector coupling portion of the high-speed transmission connector of FIGS. 6A and 6B.

Turning to FIG. 7, the description will be directed to a modification of a connector coupling portion of the high-speed transmission connector of FIGS. 6A through 6C. In the connector coupling portion, a male connector 37 has a housing 39 entirely subjected to metal plating except those portions into which contact pins 41 are press fitted. Inside the housing 39, protrusions 42 having tapered top ends are formed on a rear wall at portions where the contact pins 41 are protruded. Around each protrusion 42, a locking spring portion 44 of a metal material is implanted. The locking spring portion 44 serves as a first outer conductor.

On the other hand, a female connector 38 has a housing 40 provided with recessed portions 43 to which the protrusions 42 of the male connector 37 are guided and fixed by the locking spring portions 44. An internal wall of each recessed portion 43 is also subjected to metal plating and is electrically connected to the metal plating film of the housing 39 of the male connector 37 upon coupling of the connectors. Each contact 45 has a clamping portion 46 for clamping and holding each of the contact pins 41 and an accommodating hole having an internal wall covered with an insulator layer 47 of an insulating resin material formed by molding after metal plating so as to avoid contact with the contact 45 and short circuit with the metal plating film. Thus, an outer conductor having a shielding function is substituted by metal plating except the portions where the connector pins 41 are implanted and the accommodating holes of the contacts 45. Therefore, as compared with the prior art in which the metal component with the outer conductor press formed is attached, reduction in size and cost can be achieved.

Figure 8A:
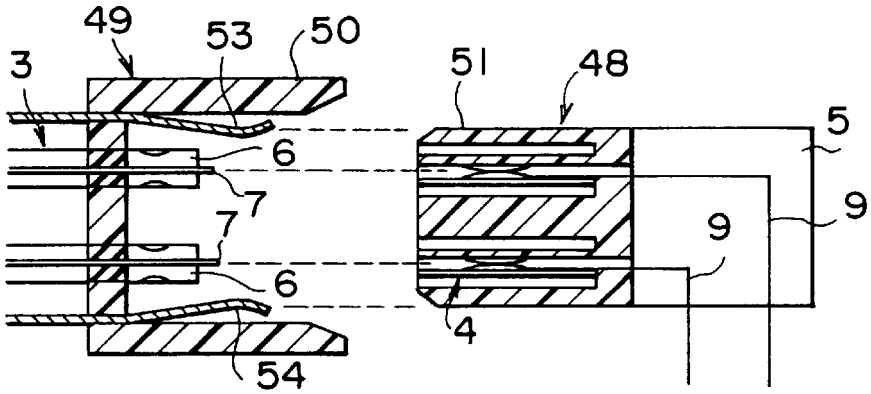
FIG. 8A is a sectional view of a high-speed transmission connector according to a third embodiment of this invention.
Figure 8B:
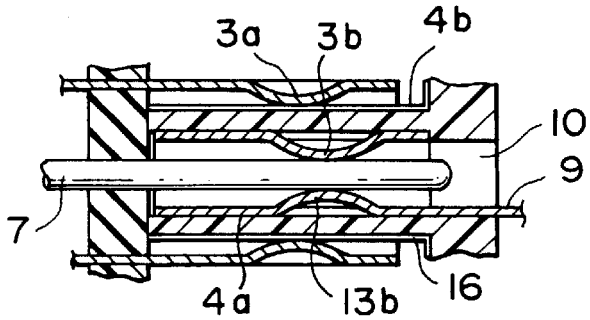
FIG. 8B is a sectional view of a connector coupling portion extracted from the high-speed transmission connector of FIG. 8A.

Referring to FIGS. 8A and 8B, the description will be made as regards a high-speed transmission connector according to a third embodiment of this invention. The high-speed transmission connector is directed to a case where grounding of the connector is developed to avoid EMI known in the art. Specifically, a female connector 48 has a housing 51 entirely subjected to metal plating except the holes 10. A male connector 49 has a housing 50 provided with a clamping spring portion 54 for clamping and holding the exterior of the housing of the female connector upon coupling of the connectors and with a shielding cylinder or plate 53 to be electrically connected to the metal plating film 16.

As described in conjunction with FIGS. 3A through 3C, partition walls 5 are subjected to metal plating to form the microstrip lines. Although not shown, a metal plating film is formed on an attaching portion of the female connector 48 to be contacted with an earth pad of a wiring board and kept at an earth potential. The state upon coupling the connectors is similar to that described in conjunction with FIG. 1 and will not be described any longer.

As described above, the insulating resin material is molded and subjected to conductive plating to serve as the external conductor forming the coaxial connector having the shielding function. As compared with the external conductor made of a metal material, each of the above-mentioned high-speed transmission connectors is advantageously simple in structure, high in productivity, and low in cost.

In addition, the thin metal film formed by plating is used instead of the external conductor formed by the molded metal article. This allows reduction in size. Furthermore, the metal films having a matching impedance are formed on the partition walls separating the terminals extracted from the connector body. This achieves impedance matching to obtain desired transmission characteristics without return loss.

What is claimed is:

1. A high-speed transmission connector comprising a male connector and a female connector adapted to connect with said male connector, said male connector comprising:

a conductive contact pin;

a first outer conductor enveloping said contact pin, and a first insulator housing holding said contact pin and said outer conductor, said female connector comprising:

a conductive socket member for being brought into contact with said contact pin with said contact pin inserted to said socket member when said female connector is connected to said male connector;

a second outer conductor enveloping said socket member for being brought into contact with said first outer conductor with being inserted to said first outer conductor so that said first outer conductor is kept at an earth potential through said second outer conductor when said female connector is connected to said male connector;

a second insulator housing holding said socket member and said second outer conductor;

a primary terminal connected to said socket member and penetrating said second insulator housing in a first direction to extend at one side of said second insulator housing along a plane extending in said first direction and a second direction perpendicular to said first direction;

an additional terminal penetrating said second insulator housing in said first direction to extend at said one side of the second insulator housing along said plane;

an insulator wall connected to said second insulator housing and extending parallel to said plane between said primary and said additional terminal; and a wall metal layer formed as a microstrip line on said insulator wall to face said primary terminal in a third direction perpendicular to said first and said second directions.

2. A high-speed transmission connector as claimed in claim 1, wherein said first outer conductor is cylindrical, said female connector further comprising a cylindrical insulator portion held to said second insulator housing and enveloping said socket member, said second outer conductor being formed around said cylindrical insulator portion.

3. A high-speed transmission connector as claimed in claim 2, wherein said socket member and said second outer conductor are placed at one side of said second insulator housing.

4. A high-speed transmission connector as claimed in claim 1, wherein said female connector further comprises a housing metal layer formed along a surface of said second insulator housing and connected to said second outer conductor and said wall metal layer.

5. A high-speed transmission connector as claimed in claim 4, wherein said female connector further comprises a grounding plate extending perpendicular to said plane to face said primary terminal in said plane.

6. A high-speed transmission connector as claimed in claim 5, wherein said insulator wall has a slit penetrating in said third direction, said grounding plate being inserted in said slit.

7. A high-speed transmission connector as claimed in claim 1, wherein said wall metal layer extends parallel to said terminal along said insulator wall and is connected to second outer conductor so that said first outer conductor is kept at an earth potential through said second outer conductor and said wall metal layer when said female connector is connected to said male connector.

8. A high-speed transmission connector as claimed in claim 1, wherein said second outer conductor is cylindrical, said first insulator housing having a cylindrical surface enveloping said contact pin, said first outer conductor being made of a metal layer formed on said cylindrical surface.

9. A high-speed transmission connector as claimed in claim 8, wherein said socket member and said second outer conductor are placed at one side of said second insulator housing, said female connector further comprising:

an inner terminal connected to said socket member and penetrating said second insulator housing to extend at another side of said second insulator housing; and an outer terminal connected to said second outer conductor and penetrating said second insulator housing to envelope said inner terminal at the other side of said second insulator housing.

10. A high-speed transmission connector as claimed in claim 1, wherein said second insulator housing surrounds said socket member, said second outer conductor being a metal layer laid on said second insulator housing, said connector further comprising an insulator layer between said metal layer and said socket member.

11. A high-speed transmission connector comprising a male connector and a female connector adapted to connect with said male connector, said male connector comprising:

a plurality of conductive contact pins arranged parallel to one another in a predetermined arrangement;

a plurality of cylindrical outer conductors enveloping said contact pins, respectively; and a first insulator housing holding said contact pins and said cylindrical outer conductors, said female connector comprising:

a plurality of cylindrical conductive members arranged parallel to one another in said predetermined arrangement, each of said cylindrical conductive members being brought into contact with each of said contact pins when said female connector is connected to said male connector;

a plurality of cylindrical insulator portions enveloping said cylindrical conductive members, respectively, each of said cylindrical insulator portions being inserted in each of said cylindrical outer conductors when said female connector is connected to said male connector;

a plurality of metal films formed around said cylindrical insulator portions, respectively, each of said metal films being brought in contact with each of said cylindrical outer conductors so that said cylindrical outer conductors are kept at an earth potential when said female connector is connected to said male connector;

a second insulator housing holding said cylindrical conductive members and said cylindrical insulator portions, wherein said second insulator housing accommodates said cylindrical conductive members arranged on a bottom thereof;

a plurality of terminals provided at a rear side of said second insulator housing, said plurality of terminals extending from rear ends of said cylindrical conductive members, protruding outwards from said second insulator housing, and bending downwards to be connected to a wiring board; and insulated partition walls separating said terminals from adjacent ones in a horizontal direction and having metal films formed on surfaces thereof to serve as microstrip lines.

12. A high-speed transmission connector as claimed in claim 11, further comprising clamping leaf spring portions connected to said cylindrical outer conductors for clamping said cylindrical insulator portions through said metal films, respectively.

13. A high-speed transmission connector as claimed in claim 11, further comprising a shielding metal cylinder penetrating said first insulator housing to collectively envelope said contact pins, said shielding metal cylinder having a clamping spring portion for holding said second insulator housing.

14. A high-speed transmission connector as claimed in claim 11, wherein each of said terminals comprising a slant portion slantly extending towards said wiring board.

15. A high-speed transmission connector as claimed in claim 11, wherein each of said metal films is split into segments in one-to-one correspondence to adjacent ones of said terminals which are arranged adjacent in a vertical direction.

16. A high-speed transmission connector as claimed in claim 11, further comprising a grounding plate having an earth potential, said grounding plate penetrating said partition walls and covering every adjacent ones of said terminals arranged adjacent in a vertical direction.

17. A high-speed transmission connector comprising a male connector and a female connector adapted to connect with said male connector, said male connector comprising:

a plurality of conductive contact pins arranged in a matrix fashion;

a first insulator housing having introducing holes for insertion of said contact pins and having inner and outer surfaces entirely covered with a metal film;

a plate attached to a rear side of said first insulator housing, said plate being penetrated by a plurality of contact pins arranged in said matrix fashion, said plate being entirely covered with a metal film except those portions of front and rear walls around said contact pins, said contact pins extending from a rear surface of said plate and bending downwards to be connected to a wiring board; and insulated partition walls separating said contact pins from adjacent ones adjacent in a horizontal direction and having metal films formed on surfaces thereof to serve as microstrip lines, said female connector comprising:

a plurality of conductive socket members each of which is inserted into a respective one of said introducing holes to be brought into contact with said contact pins in said first insulator housing when said female connector is connected to said male connector;

cylindrical conductors each of which is inserted into a respective one of said introducing holes in said first insulator housing to be brought into contact with said metal film formed on an internal wall of said introducing hole when said female connector is connected to said male connector;

a second insulator housing to which said conductive socket members and cylindrical conductors are implanted;

inner and outer terminals extending from rear ends of said conductive socket members and said cylindrical conductors, respectively.

18. A high-speed transmission connector comprising a male connector and a female connector adapted to connect with said male connector, said male connector comprising:

a plurality of contact pins arranged in a matrix fashion;

a first insulator housing having an opening formed at one end and accommodating said contact pins so that said contact pins penetrate a bottom of said first insulator housing, said first insulator housing having a protruding portion protruding from an internal wall of said bottom around each of said contact pins and having a tapered top end, said contact pins extending from an external surface of said bottom of said first insulator housing and bending downwards to be connected to a wiring board;

insulated partition walls separating said contact pins from adjacent ones in a horizontal direction and having metal films formed on surfaces thereof to serve as microstrip lines; and a locking spring portion of a metal material arranged around said protruding portion, said first insulator housing having inner and outer surfaces covered with a metal film except said locking spring portion and said protruding portions around said contact pins, said female connector comprising:

a second insulator housing having a chambered recessed portion to be fitted to said protruding portion and having holes for insertion of said contact pins;

a plurality of conductive socket members held to said second insulator housing to be brought into contact with said contact pins when said female connector is connected to said male connector; and a metal film covering said second insulator housing except an internal wall around said contact pins.

19. A high-speed transmission connector as claimed in claims 18, wherein said contact pins and said socket members are plated by a precious metal at contacting portions thereof.

* * * * *